United States Patent [19]

Behmel et al.

[11] 4,396,651

[45] Aug. 2, 1983

[54] PROCESS FOR SPRAYING WATER-DILUTABLE PAINT SYSTEMS

[75] Inventors: Klaus Behmel; Werner Gessner; Norbert Wamser; Werner Wilfinger, all of Graz, Austria

[73] Assignee: Vianova Kunstharz, A.G., Werndorf, Austria

[21] Appl. No.: 970,955

[22] Filed: Dec. 19, 1978

[30] Foreign Application Priority Data

Dec. 27, 1977 [AT] Austria ..... 9303/77

[51] Int. Cl.[3] ..... B05D 1/02

[52] U.S. Cl. ..... 427/421; 427/426; 118/313; 239/294; 239/400; 239/419.3; 239/424

[58] Field of Search ..... 427/421, 426, 335; 239/294, 295, 400, 405, 419, 419.3, 422, 424; 118/313

[56] References Cited

U.S. PATENT DOCUMENTS

| | | | |
|---|---|---|---|
| 2,511,626 | 6/1950 | Einbecker | 239/419.3 X |
| 3,033,472 | 5/1962 | Shelton | 239/419.3 X |
| 3,038,750 | 6/1962 | Nielsen | 239/422 X |
| 3,168,411 | 2/1965 | Walsh | 427/196 |
| 3,667,998 | 6/1972 | Esser | 427/426 |
| 3,715,076 | 2/1973 | Kenderi | 427/422 X |
| 3,844,485 | 10/1974 | Waggoner | 239/422 X |
| 3,857,511 | 12/1974 | Gouindan | 239/11 |
| 3,893,621 | 7/1975 | Johnson | 239/422 X |
| 3,927,833 | 12/1975 | Harrison et al. | 239/422 X |
| 3,979,535 | 9/1976 | Gouindan | 427/422 |
| 4,007,306 | 2/1977 | Poy et al. | 427/421 X |
| 4,106,697 | 8/1978 | Sickles et al. | 239/705 |
| 4,132,357 | 1/1979 | Blackinton | 427/377 X |

*Primary Examiner*—Shrive P. Beck

*Attorney, Agent, or Firm*—A. W. Breiner

[57] ABSTRACT

A spray coating process for application of water-dilutable paint systems which includes spraying a water-dilutable paint through a main nozzle which atomizes the paint and simultaneously therewith spraying at least one additional material from at least one lateral ancillary nozzle into and/or around the paint stream from the main nozzle. The additional material can be water to control the water content of the paint film, or it can be an additive such as a leveling aid for the paint. The spraying of the additional material into and around the paint stream while it is being projected to the surface to be painted causes the material to locate primarily at the surface of the atomized paint droplets.

4 Claims, No Drawings

PROCESS FOR SPRAYING WATER-DILUTABLE PAINT SYSTEMS

The invention is directed to a coating process for spray application of water-dilutable paint systems.

Water-dilutable paint systems are becoming increasingly important due to ecological and economic reasons. In principle, besides the water-dilutable binder and water, the systems contain auxiliary solvents necessary for preparation and application as well as catalysts and paint additives, such as wetting agents and antifoams, and optionally dyestuffs, pigments and extenders. The binders are either molecular dispersed solutions in water or water/solvent blends or binders in the form of dispersions or emulsions.

Water-dilutable paints are applied by the conventional methods, including spraying, roller coating, dipping, flow coating, and the like. Spray application of water-dilutable paints, for example, can be effected by pressurized air spray, airless spray, electrostatic spray, and the like. Since spray application of paints is mainly used for decoration purposes, such as finishes or single coats, the formation of excellent films under fluctuating conditions, as well as in large scale industrial coating, is of critical importance, since otherwise post-treatment is necessary.

The known disadvantages of water-soluble paints, a consequence of the specific physical properties of water, are a recognized source of disadvantages for the spray method of application and include:

(a) The evaporation rate of water depends upon the relative air humidity. When the humidity is too low, the applied coatings have a content of water which is too low, "dry films" are obtained, which films do not level out to smooth films. In stoving enamels the entrapped air bubbles are released causing permanent defects of the film. When the humidity is too high, "wet" paint films are obtained which sag from or on the substrate. In the case of stoving enamels there is also the danger of the excess water starting to boil in the stoving oven, again causing permanent film defects due to "cissing." In order to avoid such deficiencies it is necessary to employ air conditioning in the spray shop and of the total transported air which is costly.

(b) While the evaporation rate of volatile components in non-aqueous paints can be adjusted to the paint drying conditions by blending solvents of various boiling points, the relatively low boiling point of water is a cause of too rapid drying of the film, resulting in "cissing" and blisters of the film. At temperatures of below 100° C., where a satisfactory flash-off to ensure substantial evaporation of the water cannot be realized in industrial application, the coemployment of high boiling organic solvents is a practical remedy. There is, however, the disadvantage in that to achieve the desired effect in many cases large quantities of the organic solvents are required. This eliminates a principal advantage of water-dilutable paints, i.e., the ecological qualities of water paints. Additionally, the choice of solvents available for water paints is sharply curtailed by the criteria of compatibility with the aqueous paint. For example, the stability of dispersion paints can be adversely affected by use of strongly polar solvents.

(c) The high surface tension of water in most cases is responsible for poor wetting of the substrate and for susceptibility of the paint films to defects known as "craters." The addition of paint additives reducing the surface tension of the paint is a partial remedy. However, in many cases the additives cause the paints to foam which is undesirable. Thus, paint formulation is hindered, on the one hand, and, on the other hand, very tiny air bubbles are entrapped on spray application which burst upon stoving and cause permanent film defects. In order to avoid foaming, antifoaming agents are added. Since the various additives can have a negative mutual effect, they have to be carefully balanced. In many cases one or the other of the paint additives becomes ineffective on prolonged storage of the paint. Furthermore, the rapid formation of large new paint areas upon atomization at the spray nozzle of the spray gun leaves little time for the additives to migrate from the interior of the paint droplet to the surface whereby they normally should exert their effect, viz., at the surface of the paint droplets. In order to supply the newly formed surface at any time with the effective concentration of additives, the level of additives has to be increased above the level which would be required for complete coverage of the droplets, if there was sufficient time to develop an equilibrium of distribution.

It is an objective of the present invention, therefore, to greatly reduce or eliminate the difficulties as above noted in spray application of water-dilutable paint systems. The invention is thus directed to a coating process for spray application of water-dilutable paint systems employing spraying equipment containing a main spray nozzle for atomizing the paint material, characterized in that at least one, preferably two or more, ancillary nozzles are mounted at the side of the main spray nozzle whereby atomized water and/or solvents and/or paint additives and/or other liquid additives are supplied within and/or around the paint stream coming through the main nozzle. "Nozzle," in the context of the present invention, is a device wherein a paint material is atomized in a form suitable for spray application, such as a device having rotating discs, or the like.

It is known to apply a two-component system with two-component spray guns whereby the outlay of the spray nozzles guarantees a thorough blending of the two components to provide a uniform film formation. Contrary to such systems, the ancillary nozzles in the process of the present invention are to be mounted in order that the droplets of the material atomized by the nozzles either cover the main paint stream and/or blend with the droplets of the main stream without melting or blending homogeneously therewith and/or on the surface of the droplets being atomized by the main nozzle. The substances atomized by the ancillary nozzles should, to the extent possible, influence only the physical appearance of the spray stream and the applied paint film, respectively.

The mounting of the ancillary nozzles necessary for carrying out the process of the invention can be effected in various ways by modifying the known equipment for pressurized air spraying guns, airless spraying, electrostatic spraying, and the like; or a combination of the various methods. For example, a pressurized air spray gun of known construction can be used in which a part of the lateral air supply nozzles are adapted to be used as ancillary nozzles. It is advantageous to connect the ancillary nozzles with the pertinent supply system via a regulatable through-put valve and a through-put meter. It is evident that additional means may be used for transporting the material. For example, the material transport can be effected by using the gravity of an elevated positioned container or through pressure.

With the aid of the process of the invention it is possible to atomize along with the paint a quantity of water adjusted to the humidity and/or the spray room temperature, to create a "micro-climate" which makes it unnecessary to air condition the whole spray shop. Simultaneously, paint additives can be employed in an optimal manner. The general term "paint additives" as used herein includes substances such as slip aids, antifoamants, anticratering additives, wetting agents, and the like; the effect of which in many cases is their influence on the surface of the paint film. Contrary to being homogeneously distributed in the paint as in the case of additives during paint production, the additives in the process of the present invention are applied through the ancillary nozzles directly and immediately to the surface of the paint droplets. This guarantees greater efficiency and, thus, the possibility of using lower levels of additives which may, with homogeneous distribution in the paint, adversely influence the stability of the paint and/or which in the course of storage may reduce the efficiency of other paint components and/or which may in the course of storage undergo a reduction of their own efficiency. Solvents or diluted solutions of materials, including binders, which in the process of the invention are atomized through the ancillary nozzles, are present in a freely movable form, as compared to the homogeneous blending on paint production, since there is not enough time on the way from the spray nozzle to the substrate to blend with the paint sprayed from the main nozzle. These "free" substances, in many cases, in low quantity can cause a substantial increase of the leveling of the paint and of the gloss of the cured paint film.

In the following a dispersion paint system is used to demonstrate the superiority of the coating process of the present invention over the conventional methods of adjusting the paint formulation:

A white mill base XX was made as follows:

| | Parts By Weight |
|---|---|
| mill base resin[a] | 1216.3 |
| BUDIGL | 250.0 |
| Ti-dioxide | 1600.0 |
| DMEA (50% in $H_2O$) | 27.5 |
| silicone type anionic wetting agent | 16.0 |

to provide 3109.8 parts of white mill base XX.

| | Paint 1 | Paint 2 |
|---|---|---|
| white mill base XX | 622.0 | 622.0 |
| BUDIGL | 50.0 | — |
| $H_2O$ | — | 50.0 |
| hexamethoxymethylmelamine | 61.5 | 61.5 |
| catalyst blend[b] | 4.5 | 4.5 |
| silicone type wetting agent for aqueous paints (50% in $H_2O$) | 6.5 | 6.5 |
| polymer dispersion[c] | 554.0 | 554.0 |
| DMEA (50% in $H_2O$) | 4.0 | 4.0 |
| Total Parts of Paint | 1302.5 | 1302.5 |

-continued

| | Paint 1 | Paint 2 |
|---|---|---|
| paint viscosity (DIN 53 211/20° C.) | 33 s | 28 s |
| solids content | 55% | 55% |
| pH value | 8.2 | 8.2 |

The white mill base XX is prepared on a three roll mill. Prior to application the paints were diluted with water to a viscosity of 24–26 s (DIN 53 211/20° C.).

In the above formulations:

BUDIGL is diethyleneglycolmonobutylether

DMEA is dimethylethanolamine (a) is a mill base resin which is an available crosslinking acrylic resin, compatible with the polymer dispersion (c) used as the paint binder. The acrylic resin employed has an acid value of 60 to 90 mg KOH/g, a viscosity of 80–160 seconds (DIN 53 211/20° C.), and is present as an 80% solution, in organic solvents. It is used as a 28.3% aqueous solution of the material, neutralized with dimethylehtanolamine to a pH-value of about 8.

(b) is a catalyst blend composed of
19.0 parts p-toluol sulfonic acid.1 $H_2O$
24.2 parts $H_2O$
8.9 parts DMEA (c) is an available polymer dispersion for stoving paints based on acrylates. For example, a dispersion of 30% butylacrylate, 15% ethylhexylacrylate, 15% methylmethacrylate, 15% styrol, 20% propylene glycol monomethacrylate and 5% methacrylic acid was used. Solids content: 45%.

I. Spray Addition Of Water

General spray conditions:

Spray gun adjustment:
paint feed (back regulator): 2 turns open
lateral air feed (front regulator): ¾ turn open Air pressure: 5 kg/cm²

Substrate: bare steel panels, 300×300×0.8 mm

Stoving conditions: 30 min 135° C. (vertical, air circulation oven)

Flash-off prior to stoving: 15 min (vertical)

TABLE I

| | | | | Evaluation | | | | |
|---|---|---|---|---|---|---|---|---|
| Paint | 1X | 2X | 3X | 4X | 5X | 6X | 7X | 8X |
| 1 | (aX) | 26° C. | 55% | — | — | 40 | very poor | slight |
| 1 | (bX) | 26° C. | 55% | 1a | 8 | 50 | o.k. | none |
| 1 | (aX) | 22° C. | 60% | — | — | 35 | good | substantial |
| 1 | (bX) | 22° C. | 60% | 1s | 8 | 40 | o.k. | none |
| 2 | (aX) | 24° C. | 60% | — | — | 35 | poor | substantial |
| 2 | (bX) | 24° C. | 60% | 1s | 8 | 38 | o.k. | none |
| 2 | (aX) | 28° C. | 40% | — | — | 30 | very poor | slight |
| 2 | (bX) | 28° C. | 40% | 2s | 13 | 37 | o.k. | none |

1X: spray gun employed: (aX) SATA GRZ, spray nozzle 1.2 mm, cup feed, normal model; (bX) SATA GRZ, spray nozzle 1.2 mm, cup feed, modified type, with one (=asymmetrical) or two (=symmetrical) lateral ancillary nozzles.

2X: room temperature

3X: relative humidity

4X: ancillary nozzle: 1 diameter 0.41 mm; 2 diameter 0.52 mm; a: asymmetrical; s: symmetrical 5X: through-put of ancillary nozzle g/min 6X: dry film thickness in μm 7X: leveling TABLE I-continued

| Paint | 1X | 2X | 3X | Evaluation 4X | 5X | 6X | 7X | 8X |
|---|---|---|---|---|---|---|---|---|
| 8X: sagging of the paint | | | | | | | | |

II. Spray Addition Of Solvents

Paint 2, solids content 55%, viscosity: 25 s (DIN 53 211/20° C.),
Ancillary nozzle: 3 a (diameter 0.58 mm, asymmetric),
Quantity of additional sprayed liquid: about 320 g/1000 g paint,
Air temperature: 25° C.
Relative humidity: 60%
General spray conditions: as in I. above.

TABLE II

| Spray Gun | Ancillary Nozzle Solvent Blend | Evaluation Film Thickness | Leveling | Sagging | Gloss (visual) |
|---|---|---|---|---|---|
| normal | | 40 μm | poor | yes | very poor |
| modif. | BUDIGL:$H_2O$ = 1:1 | 40 μm | good | none | good |
| modif. | diacetonealc.: $H_2O$ = 1:1 | 40 μm | very good | none | very good |
| modif. | ethanol:$H_2O$ = 1:1 | 40 μm | good | none | fair |
| modif. | acetone:$H_2O$ = = 1:1 | 40 μm | very good | none | very good |
| modif. | ethyleneglycol: $H_2O$ = 1:1 | 40 μm | very good | none | good |

III. Spray Addition Of Additives

Paint 2, solids content 55%, viscosity: 25 s (DIN 53 211/20° C.)
For application with the modified spray gun, the paint was used without leveling aid.
Ancillary nozzle: 3 a (diameter 0.58 mm, asymmetrical)
Quantity of additional sprayed liquid: 320 g/1000 g paint
Liquid: various concentrations of a silicone type leveling aid dissolved in a 1:1 blend of acetone and water
Air temperature: 23° C.
Relative humidity: 65%
General spray conditions: as in I. above.

TABLE III

| Spray Gun | Concentration Of Leveling Aid+++ | Evaluation Concentration Of Leveling Aid, Calculated on Spray Dilution of Paint | Leveling | Dry Film Thickness μm |
|---|---|---|---|---|
| normal | — | 0.25% | fair | 32 |
| modified | 0.8% | 0.26% | very good | 34 |
| modified | 0.6% | 0.20% | very good | 33 |
| modified | 0.4% | 0.13% | good+ | 31 |
| modified | 0.2% | 0.07% | poor++ | 33 |

+with half the quantity superior to blank test.
++seems to be below effective level.
+++percentage of the leveling aid is based on the total of the additional sprayed liquid.

SATA Spray guns are produced by Sanitaria GmbH, Fabrik für Farbspritzgeräte, in D-7140 Ludwigsburg, Western Germany.

It will be apparent that various modifications can be made in the process and device. Such modifications and others being within the ability of one skilled in the art are within the scope of the present application and appended claims.

It is claimed:

1. A spray coating process for application of water-dilutable paint systems to a surface to be painted with a decorative coating comprising (1) spraying a water-dilutable paint through a main nozzle to atomize said paint; and (2) simultaneously with (1) spraying a stream of water atomized by at least one ancillary nozzle around the atomized paint stream from said main nozzle before said atomized paint stream reaches the surface to be painted building up a substantially uniform water atmosphere around the paint stream without said water being homogeneously mixed with said paint.

2. The process of claim 1 wherein said water is sprayed from a plurality of ancillary nozzles.

3. The process of claim 1 wherein said water sprayed from said ancillary nozzle includes a solvent mixed with said water.

4. The process of claim 1 wherein said water sprayed from said ancillary nozzle includes a paint leveling aid.

* * * * *